US006939192B1

(12) United States Patent
Munch et al.

(10) Patent No.: US 6,939,192 B1
(45) Date of Patent: Sep. 6, 2005

(54) PROGRAMMABLE TOY WITH COMMUNICATION MEANS

(75) Inventors: Gaute Munch, Langå (DK); Jesper Rasmussen, Bredsten (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/890,739

(22) PCT Filed: Feb. 4, 2000

(86) PCT No.: PCT/DK00/00050

§ 371 (c)(1),
(2), (4) Date: Jan. 16, 2002

(87) PCT Pub. No.: WO00/45925

PCT Pub. Date: Aug. 10, 2000

(30) Foreign Application Priority Data

Feb. 4, 1999 (DK) ..... 1999 00144

(51) Int. Cl.[7] ..... A63H 33/04
(52) U.S. Cl. ..... 446/91; 446/436
(58) Field of Search ..... 446/96, 454, 456, 446/436, 465, 85, 91, 83, 175; 345/122, 157, 345/474; 463/36–37, 39, 46; 434/118; 901/1, 901/3, 50, 46–47

(56) References Cited

U.S. PATENT DOCUMENTS

| | | | | |
|---|---|---|---|---|
| 4,109,398 | A * | 8/1978 | Hida | 434/370 |
| 4,712,184 | A * | 12/1987 | Haugerud | 446/454 |
| 4,802,879 | A | 2/1989 | Rissman | |
| 4,938,483 | A | 7/1990 | Yavetz | |
| 5,127,658 | A | 7/1992 | Openiano | |
| 5,259,626 | A * | 11/1993 | Ho | 463/37 |
| 5,724,074 | A * | 3/1998 | Chainani et al. | 446/465 |
| 6,083,104 | A * | 7/2000 | Choi | 463/6 |
| 6,290,565 | B1 * | 9/2001 | Galyean, III et al. | 446/99 |

FOREIGN PATENT DOCUMENTS

| | | |
|---|---|---|
| CA | 2225060 | 10/1998 |
| WO | WO 90/02983 | 3/1990 |

* cited by examiner

*Primary Examiner*—Mark Sager
(74) *Attorney, Agent, or Firm*—Pitney Hardin LLP

(57) ABSTRACT

A programmable toy with a receiver for receiving instructions for programming of the toy, and elements for executing received instructions. The toy has a transmitter for transmission of instructions to a second toy.

33 Claims, 8 Drawing Sheets

PROGRAMMABLE TOY WITH COMMUNICATION MEANS

BACKGROUND OF THE INVENTION

1. Field of the Invention

The invention relates to a microprocessor controlled toy building element comprising a microprocessor which can execute instructions in the form of a program stored in a memory, said memory comprising subprograms which can be activated individually by specifying a list of subprogram calls; coupling means for coupling with building elements which can be moved by activation means, said activation means being controllable in response to the instructions.

2. Description of the Prior Art

In connection with the development of small, sophisticated and relatively inexpensive microprocessors it has become attractive to use these in many different consumer products—including toys. Generally, the development of toys has proceeded from simple functions such as playing of sounds in dolls, performance of simple patterns of movement in robots, etc., to the development of toys with sophisticated patterns of action and a form of behaviour.

Such toy building elements can perform different physical actions partly by programming the toy building element and partly by building a structure which consists of interconnected toy building elements of different types. Thus, there are numerous combination possibilities of making structures and giving the structures various functions. The physical actions may be unconditional and comprise simple or complex movements controlled by an electric motor as well as emission of light and sound signals. The physical actions may also be conditioned by the interaction of the toy with its surroundings, and the toy may then be programmed to respond to physical contact with an object or to light and optionally sound and to change its behaviour on the basis of such an interaction.

Such programmable toys are known e.g. from the product ROBOTICS INVENTION SYSTEM from LEGO MINDSTORMS, which is a toy which can be programmed by a computer to make unconditioned as well as conditioned actions.

CA 2,225,060 relates to interactive toy elements; a first toy element activated by a user can activate a second toy element, which can in turn activate the first toy element or a third toy element. The toy elements may be in the form of dolls, animals or a car which can perform activities.

However, it is a problem of this toy that the toy requires an external computer for the user-defined programs to be transferred to such a microprocessor controlled toy element. It has been a prejudice within the prior art that exchange of programs between toy elements is relevant only between identical toy elements, since, otherwise, the interaction between a program and a mechanical structure will involve possibilities of error.

Within the field of construction toys it is a typical situation that structures are built and modified repeatedly. Since this is part of the game, there is thus a need for the ability to activate a new program adapted to the specific structure.

Accordingly, an object of the invention is to provide a microprocessor controlled toy building element having more flexible programming functions.

BRIEF SUMMARY OF THE INVENTION

This is achieved when the microprocessor controlled toy building element mentioned initially is characterized by comprising communications means which can transmit said function call to a second toy building element for programming of it.

Thereby, a first microprocessor controlled toy building element can transmit a list of function calls to a second microprocessor controlled toy building element. When the second toy building element has stored subprograms known by the first toy building element, programs can rapidly be exchanged between two toy building elements. Thereby the potential of construction toys based on the functionality between a plurality of standard building elements in a structure and a plurality of standard program steps may be utilized in an effective manner.

BRIEF DESCRIPTION OF THE SEVERAL VIEWS OF THE DRAWINGS

A preferred embodiment of the invention will be described below with reference to the drawing, in which.

DETAILED DESCRIPTION OF THE INVENTION

Figure 1:
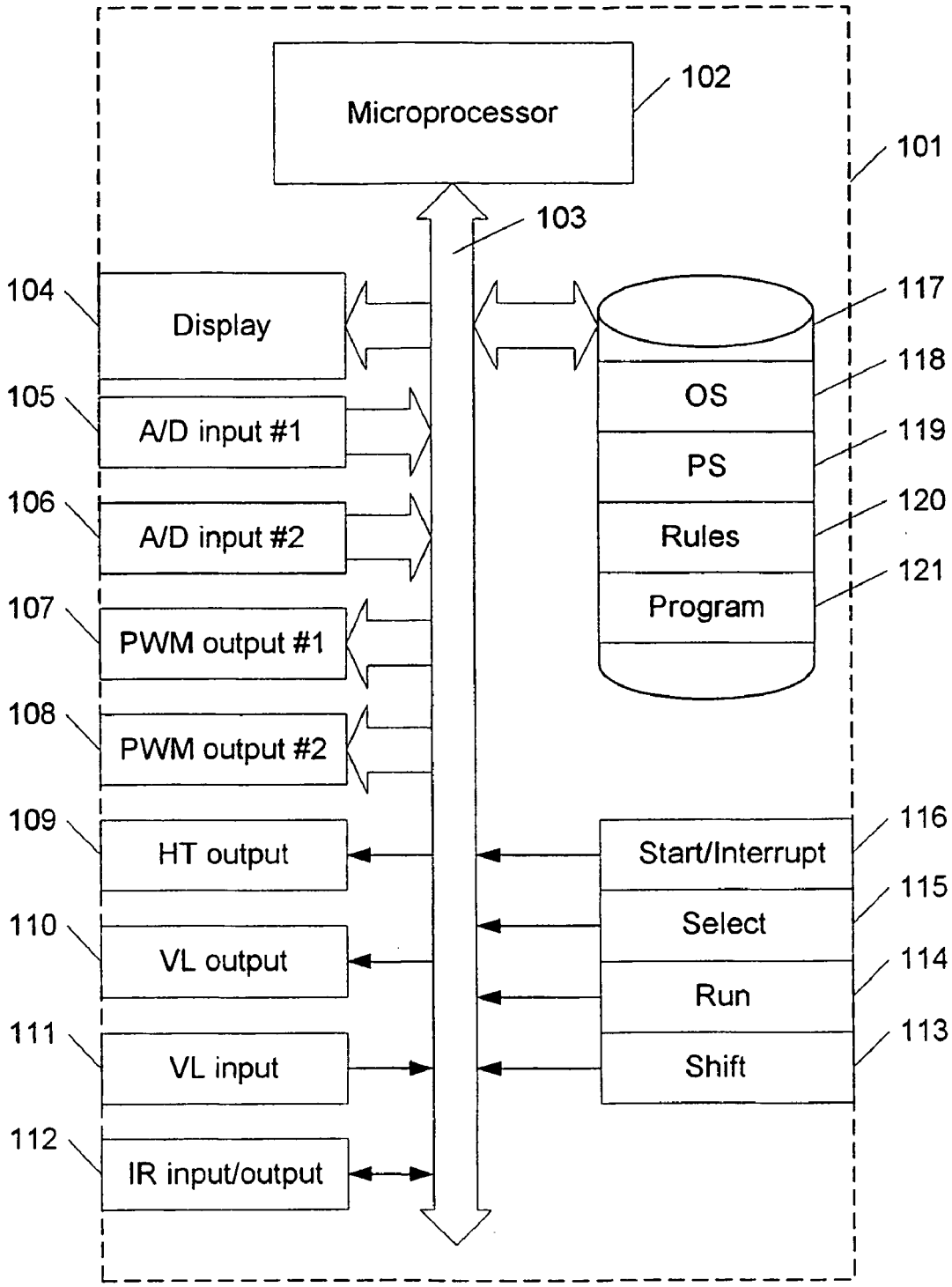
FIG. 1 shows a block diagram of a programmable toy element.

FIG. 1 shows a block diagram of a programmable toy element. The toy element 101 comprises a plurality of electronic means for programming the toy element so that it can affect electronic units (e.g. motors) in response to signals picked up from various electronic sensors (e.g. electrical switches).

The toy element may hereby be caused to perform sophisticated functions such as e.g. action controlled movement, provided that the toy element is combined with the electronic units/sensors in a suitable manner.

The toy element 101 comprises a microprocessor 102 which is connected to a plurality of units via a communications bus 103. The microprocessor 102 can receive data via the communications bus 103 from two A/D converters "A/D input #1" 105 and "A/D input #2" 106. The A/D converters can pick up discrete multibit signals or simple binary signals. Further, the A/D converters are adapted to detect suitable values such as e.g. ohmic resistance.

The microprocessor 102 can control electronic units such as e.g. an electric motor (not shown) via a set of terminals "PWM output #1" 107 and "PWM output #2" 108. In a preferred embodiment of the invention the electronic units are controlled by a pulse width modulated signal.

Moreover, the toy element can emit sound signals or sound sequences by controlling a sound generator 109, e.g. a loudspeaker or piezoelectric unit.

The toy element can emit light signals via the light source "VL output" 110. These light signals can be emitted by means of light emitting diodes. The light emitting diodes may e.g. be adapted to indicate various states of the toy element and the electronic units/sensors. The light signals may furthermore be used as communications signals for other toy elements of a corresponding type. The light signals may e.g. be used for transferring data to a second toy element via a light guide.

The toy element can receive light signals via the light detector "VL input" 111. These light signals may be used inter alia for detecting the intensity of the light in the room in which the toy element is present. The light signals may alternatively be received via a light guide and represent data from a second toy element or a personal computer. The same light detector may thus have the function of communicating via a light guide and of serving as a light sensor for detecting the intensity of the light in the room in which the toy element is present.

In a preferred embodiment, the "VL input" 111 is adapted to selectively either communicate via a light guide or alternatively to detect the intensity of the light in the room in which the toy element is present.

Via the infrared light detector "IR input/output" 112 the toy element can transfer data to other toy elements or receive data from other toy elements or e.g. a personal computer.

The microprocessor 102 uses a communications protocol for receiving or transmitting data. Transmission of data may take place by activating a special key combination.

The display 104 and the keys "shift" 113, "run" 114, "select" 115 and "start/interrupt" 116 constitute a user interface for operating/programming the toy element. In a preferred embodiment, the display is an LCD display that can show a plurality of specific icons or symbols. The appearance of the symbols on the display may be controlled individually, e.g. an icon may be visible, be invisible and be caused to flash.

By affecting the keys the toy element may be programmed at the same time as the display provides feedback to a user about the program which is being generated or executed. This will be described more fully below. As the user interface comprises a limited number of elements (that is a limited number of icons and keys), it is ensured that a child who wants to play with the toy will quickly learn how to operate it.

The toy element also comprises a memory 117 in the form of RAM or ROM. The memory contains an operating system "OS" 118 for control of the basic functions of the microprocessor, a program control "PS" 119 capable of controlling the execution of user-specified programs, a plurality of rules 120, each rule consisting of a plurality of specific instructions for the microprocessor, and a program 121 in RAM which utilizes the specific rules.

The rules may be designed as subprograms which may be called by a function call. This is also called scripting. A program (e.g. a user-specified one) may thus be designed as a combination of function calls. When transmitting a program to another microprocessor controlled toy building element, merely the function calls may be transferred, if the subprograms are known by the toy building element which is to receive the program. Transmission of a program may be started by activating a key combination or by activating a special icon on the display 201.

In a preferred embodiment, the toy element is based on a so-called single chip processor which comprises a plurality of inputs and outputs, a memory and a microprocessor in a single integrated circuit.

In a preferred embodiment, the toy element comprises light emitting diodes which can indicate the direction of revolution of the connected motors.

Figure 2:
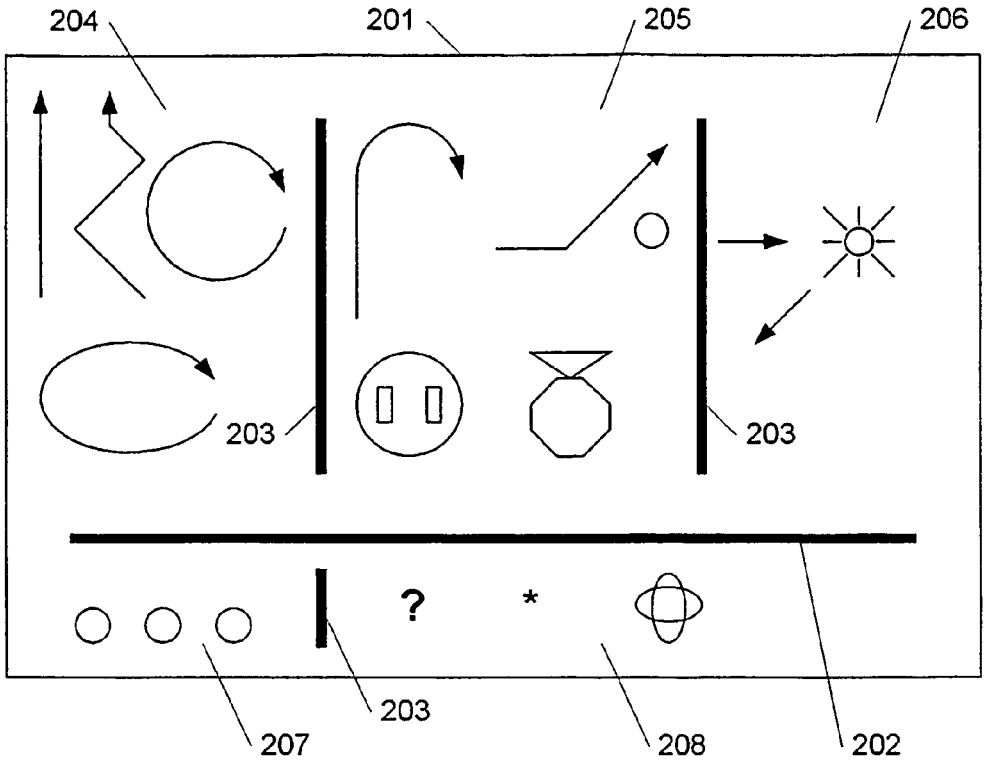
FIG. 2 shows a display on a toy element.

FIG. 2 shows a display on a toy element. The display 201 is adapted to show a plurality of specific icons and is shown in a state in which all the icons have been made visible. The icons are divided by horizontal and vertical beams 202 and 203, respectively, into a plurality of groups 204, 205, 206, 207 and 208 according to their function.

The icons may e.g. be designed to illustrate possible patterns of movement for a vehicle. A vehicle may e.g. be constructed by combining the toy element with two motors which can drive a set of wheels at the right-hand side and the left-hand side, respectively, of a vehicle. The vehicle may hereby be controlled to drive forwards, backwards, to the left and to the right. Further, the vehicle may comprise pressure-sensitive switches for detecting collision and light-sensitive sensors.

The group 204 includes icons for a straight and forwardly directed pattern of movement, a forwardly directed zigzag pattern of movement, a circular movement and a movement which repeats a given pattern. These patterns of movement are not conditioned by the action of sensors and are therefore unconditioned.

The group 205 includes a first icon for a pattern of movement, which is reversed when an obstacle is detected. A second icon shows a straight and forwardly directed pattern of movement, where the forwardly directed movement is merely corrected by the detection of an obstacle. A third icon conditions initiation of a pattern of movement. A fourth icon stops an ongoing pattern of movement when a pressure sensor is activated. The icons in the group 205 thus represent patterns of movement which are conditioned by pressure-sensitive sensors.

The group 206 includes icons for starting a pattern of movement which moves toward the strongest light intensity and a pattern of movement which moves toward the weakest light intensity, respectively. The light intensity is detected by means of light-sensitive sensors. The icons in the group 205 thus represent patterns of movement which are conditioned by light-sensitive sensors.

The group 207 includes three identical icons which can be displayed in combination to indicate the time constant at which the mentioned patterns of movement are to be performed. For example, the zigzag pattern may be modified by stepwise changing the period of time which has to elapse before the direction is changed. The time constant may e.g. be 2 seconds, 4 seconds and 7 seconds.

The group 208 comprises icons which represent a plurality of special effects. These effects may e.g. comprise emission of various sound and light signals optionally combined with an arbitrary activation of the mentioned patterns of movement.

As the toy element of the invention includes a building element which may be coupled with other building elements, it is particularly easy to realize the functions which can be seen on the icons by building a structure with a plurality of standard elements.

It should be noted that the display may be of LCD type, LED type or another type. The display may moreover be adapted to show various forms of text messages. Icons may also be text.

Figure 3A:
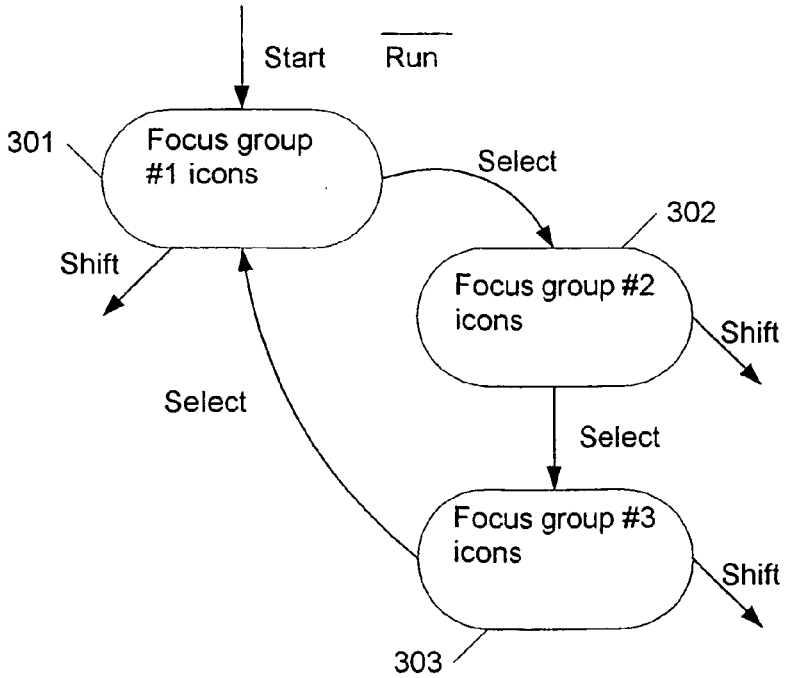
FIG. 3*a* shows a first diagram of a state machine for visual programming of a toy element.

FIG. 3*a* shows a first diagram of a state machine for visual programming of a toy element. The state machine is implemented as a program which can be executed by the microprocessor 102. When the state machine does not execute a user-specified program, and when the toy element has been turned on, activation of the key "select" will direct focus from one group of icons to another group of icons. That a group of icons is in focus may be shown by flashing an icon in a group or all the icons in a group. The state machine shown comprises three states 301, 302 and 303 corresponding to switching focus between three different groups of icons.

The state machine changes states when the keys "select" or "shift" are activated. When the key "select" is activated, switching takes place between the states 301, 302 and 303. When the key "shift" is activated, the state machine continues in another set of states, as shown in FIG. 3*b*.

It should be noted that just three states are indicated in this program, corresponding to three groups of icons on the display 201. This has been chosen in order to make the diagram readily understandable. In practice, there must be a number of states corresponding to the number of groups of icons on the display. Further, there may be a state for the transmission of programs.

Figure 3B:
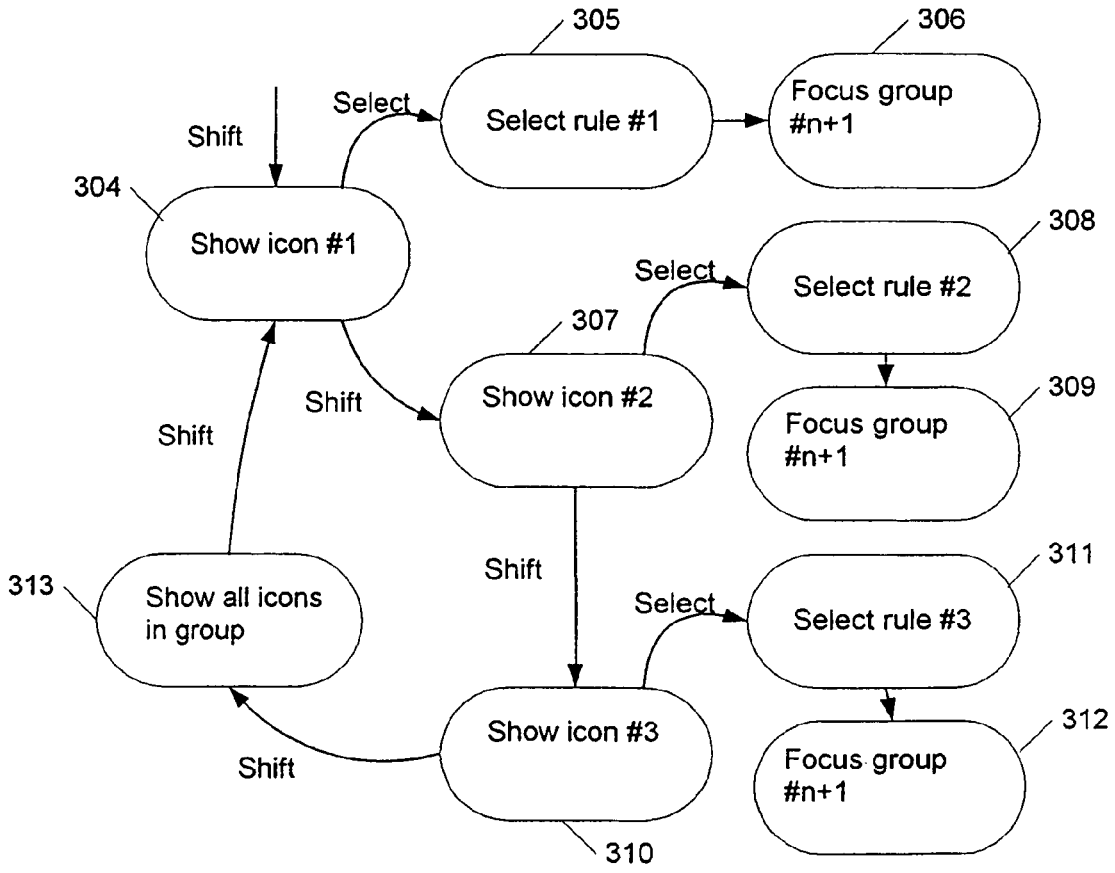
FIG. 3*b* shows a second diagram of a state machine for visual programming of a toy element.

FIG. 3*b* shows a second diagram of a state machine for visual programming of a toy element. The state machine is caused to assume these states when the key "shift" is activated. It is assumed that a group of icons has been focused. When "shift" is activated, the state machine assumes the state 304 in which the first icon in the group which has been focused is activated—the other icons in the same group are not shown.

If the key "select" is activated, the state machine assumes the state 305 where "rule #1" is selected. "Rule #1" corresponds to a set of instructions for the microprocessor 102 which can perform a pattern of movement as shown on the icon "icon #1". Then the state machine assumes the state 306 where focus is moved from the current group of icons to another group of icons for the selection of an icon in this group.

Alternatively, if the key "shift" is selected in the state 304, the state machine assumes the state 307, where the "icon #2" is shown on the display—the other icons in the same group are not shown. Like in the state 304, it is possible in the state 307 to select a rule corresponding to the icon. This is done by activating the key "select", and then the state machine assumes the state 308 for the selection of the rule "rule #2". Subsequently, in state 309 focus is moved to the next group of icons.

Correspondingly, "icon #3" may be displayed in state 310 by activation of "shift". "Rule #3" may be selected by activation of "select", following which focus is moved to another group.

A further activation of "shift" in the state 310 causes all the icons in the group to be shown, and then the icons in the group are shown individually as described above.

In the states 306, 309 and 312, activation of the key "shift" will cause the state machine to assume one of the respective states 302 or 303 or 301.

It should be noted that it is also possible not to select a rule in one or more groups. In alternative embodiments, it can moreover be made possible to select several rules in the same group.

Additionally, it should be noted that this diagram corresponds to a display with just three icons in each group. This has been chosen to make the diagram readily understandable. In practice, there must be a number of states corresponding to the number of icons in a given group.

Generally, activation of the key "run" 114 will cause the state machine to assume a state in which a program is executed—irrespective of the number of selected rules. Thus, it is not necessary to ask the user whether the program is ready or not.

It is possible to jump to a desired group of icons in order just to change a rule in a user-specified program consisting of several rules.

In a selected state of the state machine, a specified program can be transmitted.

Figure 3C:
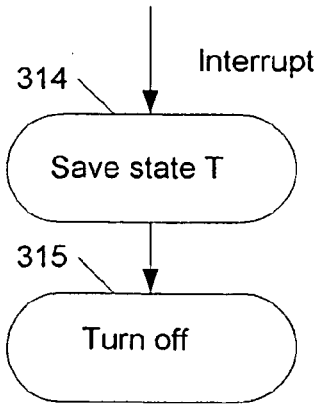
FIG. 3*c* shows a third diagram for interrupting a state machine.

FIG. 3*c* shows a third program for the interruption of a state machine. This program shows how the state machine in state 314, upon activation of "interrupt", stores a representation of the state T in which the microprocessor/state machine is present. It is hereby possible to resume a suddenly interrupted programming course without having to start from scratch. The toy element is turned off in state 315.

Figure 3D:
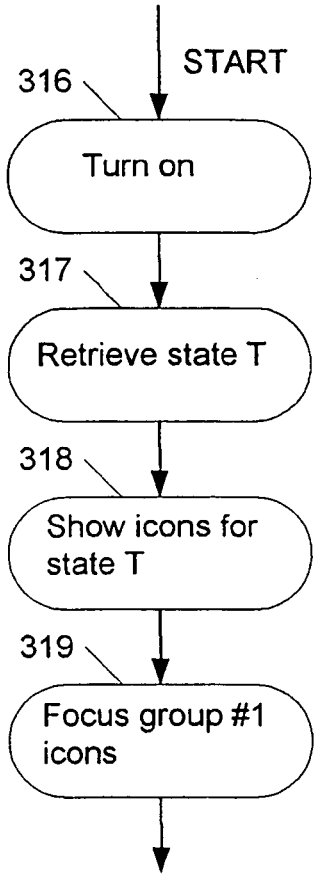
FIG. 3*d* shows a fourth diagram for starting a state machine.

FIG. 3*d* shows a fourth diagram for starting a state machine. This program shows how the state machine, upon activation of "start", turns on the toy element in state 316. Then, a previously stored state representation T is retrieved in state 317. In state 318, the icons representing the state T are shown. In state 319, the icons in group 1 are focused, and then the state machine is ready for operation as described in connection with FIGS. 3*a*, 3*b* and 3*c*.

As will appear from the above description of FIGS. 3*a*, 3*b*, 3*c* and 3*d*, the user can program the toy element in a simple manner to execute programs which comprise complicated functions. The programs are generated by combining a number of specific rules.

The state machine described above may be implemented in a very compact manner. It is ensured hereby that sophisticated and user-specified functions can be performed in response to a simple dialogue with the user.

In the states where a rule is selected, that is the states 305, 308 and 311, the program system 119 executes a number of operations, thereby generating a user-specified program which can be executed by the microprocessor 102.

The user-specified program can be generated by storing a reference (that is a pointer) in the memory 121 which refers to a rule stored in the memory 120. When several rules are selected to be included in the same user-specified program, a list of references to rules in the memory 120 is stored in the memory 121. A user-specified program may thus comprise one or more rules.

Alternatively, the user-specified program may be programmed by making a copy of each of the selected rules in the memory 120 and inserting the copies into the memory 121; the memory 121 will hereby contain a complete program. Furthermore, the user-specified program may be generated as a combination of references to rules and instructions to the microprocessor 102.

It should be noted that each rule typically comprises a set of instructions which may be considered a subprogram, a function or a procedure. But a rule may also just comprise modification of a parameter e.g. a parameter which indicates the speed of a connected motor or a time constant.

In an expedient embodiment of the invention, a given action may be performed when the state machine changes from a first state to a second state. An action may e.g.

comprise signalling with sound and/or light to the user to indicate the state or type of state which the toy element has assumed.

Figure 4:
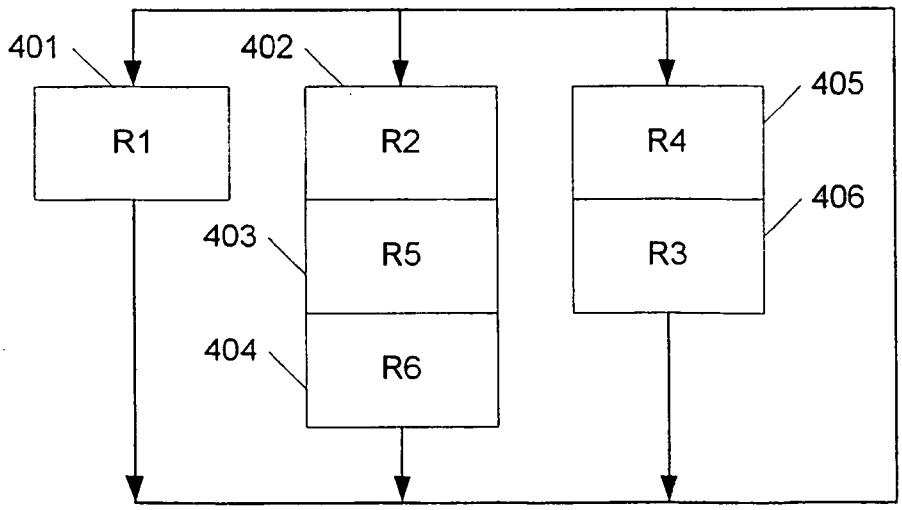
FIG. 4 shows parallel and sequential execution of programs.

FIG. 4 shows parallel and sequential execution of programs. When a user-specified program is generated, the rules may be executed as a sequence of rules, in parallel or in a combination of sequential and parallel program execution.

An example of two rules to be executed in parallel in time may be a first rule that a vehicle is to search for light, and a second rule that the vehicle is to change its direction when it detects obstacles.

An example of two rules to be performed sequentially in time may be a first rule that the vehicle is to drive straight ahead, and a second rule that the vehicle is to drive in a circular movement.

Rules R1 401, R2 402, R3 406, R4 405, R5 403 and R6 404 provide an example of a combination of sequential and parallel program execution.

When rules are executed as subprograms run in parallel in time, or in some form of time division between the subprograms, it must be possible to handle situations in which several rules want access to a resource e.g. in the form of a motor. In a preferred embodiment, such a situation is handled by allocating a priority number to each of the rules which may be selected. For example, rules within the same group of icons on the display may be given the same priority number. When the operating system 118 detects that two rules or subprograms both want access to a resource within a period of time, the rule having the lowest priority number is interrupted or stopped. The rule with the highest priority number is then allowed to use the resource. If only one rule can be selected from the same group of icons, a unique and predictable program execution of user-specified programs is thus achieved.

Figure 5:
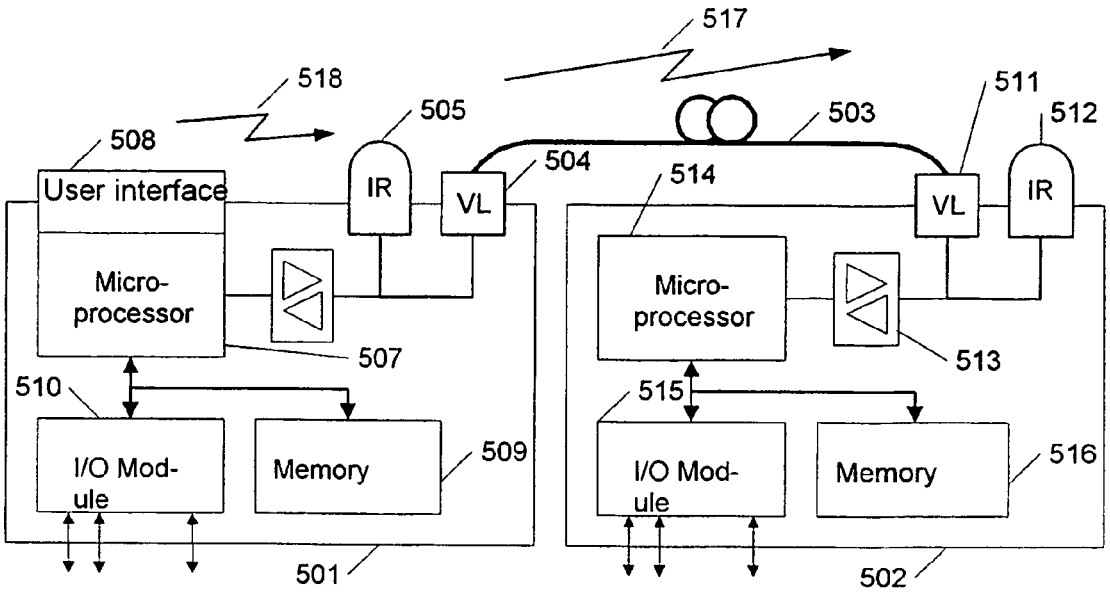
FIG. 5 shows first and second toy elements, where the first toy element can transfer data to the second toy element.

FIG. 5 shows first and second toy elements, where the first toy element can transfer programs to the second toy element. The first toy element 501 comprises a microprocessor 507, a I/O module 510, a memory 509 and a user interface 508. The toy element 501 moreover comprises a two-way communications unit 506 for communication via an infrared transmitter/receiver 505 or for communication by means of a light source/light detector 504 which can emit and detect visible light.

Correspondingly, the second toy element 502 comprises a microprocessor 514, a I/O module 515 and a memory 516. The toy element 502 moreover comprises a communications unit 513 for communication via an infrared transmitter/receiver 512 or for communication by means of a light source/light detector 511 which can emit and detect visible light.

In a preferred embodiment of the invention, the first toy element can both transmit and receive data, while the second toy element can only receive data.

Data can be transferred as visible light via a light guide 503. Alternatively, data may be transferred as infrared light 517 and 518. Data may be in the form of codes that indicate a specific instruction and associated parameters which can be interpreted by the microprocessors 507 and/or 514. Alternatively, data may be in the form of codes which refer to a subprogram or rule stored in the memory 516.

The I/O modules 510 and 515 may be connected to electronic units (e.g. motors) for control of these. The I/O modules 510 and 515 may also be connected to electronic sensors so that the units may be controlled in response to detected signals.

In a preferred embodiment, the fibre 503 is adapted such that part of the visible light transmitted by it escapes from the fibre. It is hereby possible for a user-directly-to watch the transmission. The user can e.g. see when the communication begins and stops.

The light through the fibre can transfer data with a given data transmission frequency as changes in the light level in the fibre. Data may be transmitted such that it is possible for the user to observe individual light level changes during a transmission (that is at a suitably low data transmission frequency), or merely by seeing whether the transmission is going on (that is at a suitably high data transmission frequency).

Generally, it is undesirable that part of the light to be transmitted through the fibre escapes from the fibre. But in connection with communication between two toy elements, it is a desired effect, since it is then possible to watch the communication in a very intuitive manner.

It is known to a skilled person how to ensure that part of the light escapes from the fibre. It can e.g. be done by imparting impurities to the sheath of the fibre, or by making mechanical notches or patterns in the fibre. The part of the light which is to escape from the fibre may also be controlled by controlling the ratio of the refractive index of a core to that of a sheath of a light guide.

It will be described below how a program may be received in the toy element 502 when this is in a state R=P.

Figure 6:
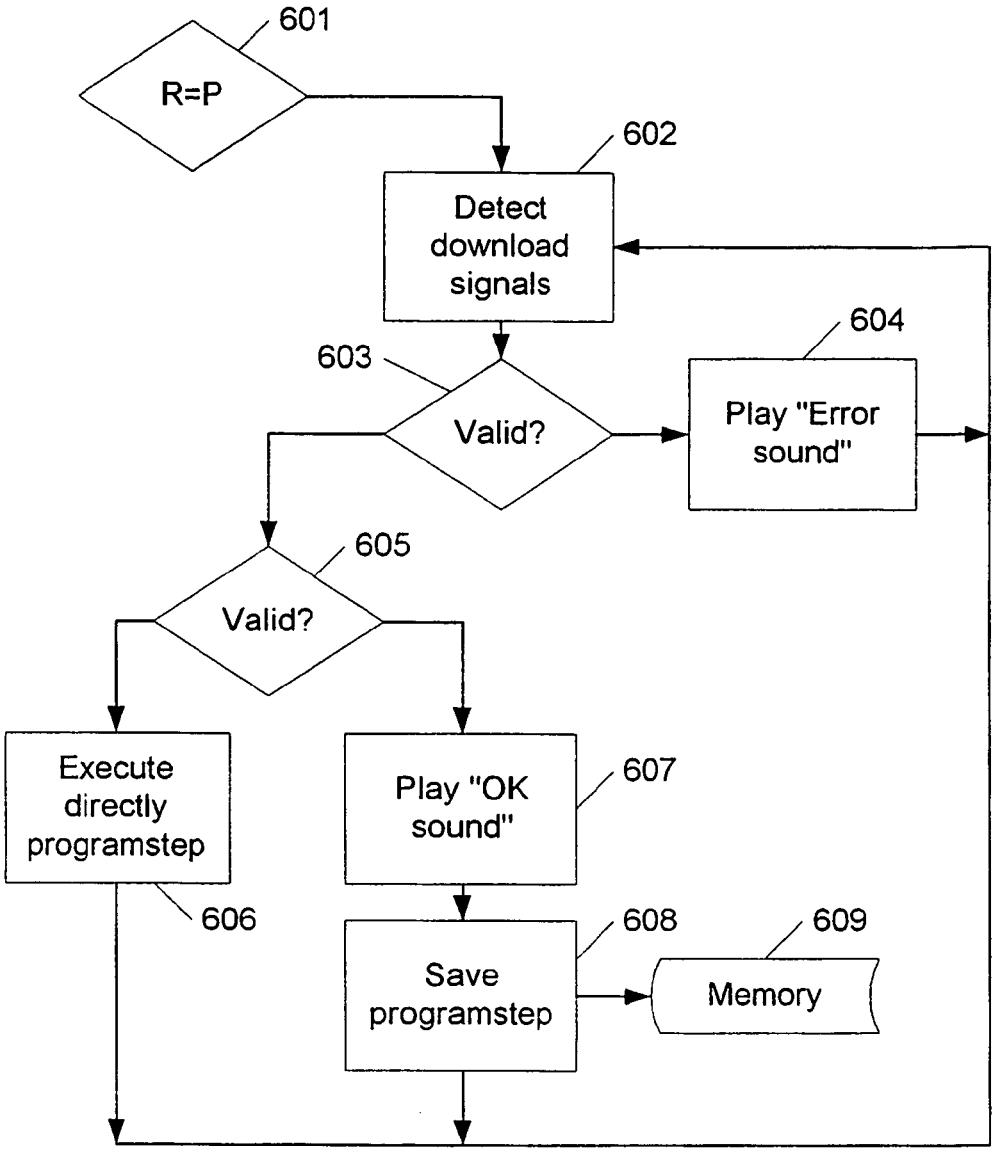
FIG. 6 shows a flow chart for storing program steps.

FIG. 6 shows a flow chart for the storage of program steps. The flow chart shows how a user can store own rules transferred from an external unit for example a second toy element, as stated above, or from a personal computer. In an embodiment, only references to the rules stored in the toy element are transferred. This reduces the necessary bandwidth for communication between the toy elements. It is checked in step 602 whether download signals are received from external units. If this is the case, it is checked in step 603 whether the download signals are valid. If the signals are not valid (no), a sound indicating an error is played in step 604. If the signals are valid (yes), it is checked whether the signals are to be interpreted as commands which are to be executed at once (execute), or whether the signals are to be interpreted as commands which are to be stored with a view to subsequent execution (save). If the commands are to be executed at once, this is done in step 606, and then the program returns to step 602. If the commands are to be stored, a recognition sound is played in step 607 and the command is stored as a program step in step 608 in the storage 609.

An example of a command to be carried out at once may be that the commands in the storage 609 are to be executed.

In an alternative embodiment, the user's own rules may be formed by making a combination of existing rules without using an external unit.

Examples of possible functions of a number of rule based programs R1–R7 are given below (rule 1, rule 2, rule 3, rule 4, rule 5, rule 6 and rule 7).

Rule 1:

1) A pause of 1 second.
2) A sound sequence (start sound) is played.
3) A pause of 0.5 second.
4) A sound sequence (backward sound) is played.
5) The motor runs backwards for 5 seconds.
6) The motor stops.
7) Points 3–6 are repeated twice (3 times in all).
8) The rule is stopped.

Rule 2:

9) A pause of 1 second.
10) A sound sequence (start sound) is played.

11) A pause of 0.5 second.
12) A sound sequence (backward sound) is played.
13) The motor runs backwards for 5 seconds.
14) The motor stops.
15) A pause of 0.5 second.
16) A sound sequence (forward sound) is played.
17) The motor runs forwards for 5 seconds.
18) The motor stops.
19) Points 3–10 are repeated twice (3 times in all).
20) The rule is stopped.

Rule 3:

1) A pause of 1 second.
2) A sound sequence (calibrate sound) is played.
3) A sound sequence (start sound) is played.
4) A sound sequence (backward sound) is played.
5) The motor runs backwards for max. 7 seconds.
6) If light is detected before the 7 seconds have elapsed (point 5):
   The motor stops.
   Forward sound sequence is played.
   The motor runs forwards as long as light is detected.
   If light disappears:
   i. The motor stops after 0.5 second.
   ii. If the light comes back within 2 seconds, the motor starts again.
   iii. If the light is out for 2 seconds, then the motor remains turned off.
7) Points 4–6 are repeated as long as light is detected within the 7 seconds and until 3 attempts without light have been made.
8) The motor stops.
9) The rule stops.

Example of the user's experience: A model is constructed such that when the model drives backwards the model turns, and when it drives forwards it drives straight ahead. The rule therefore gives a search light function—when the user throws light on the model, the model drives forwards toward the user.

Figure 7:
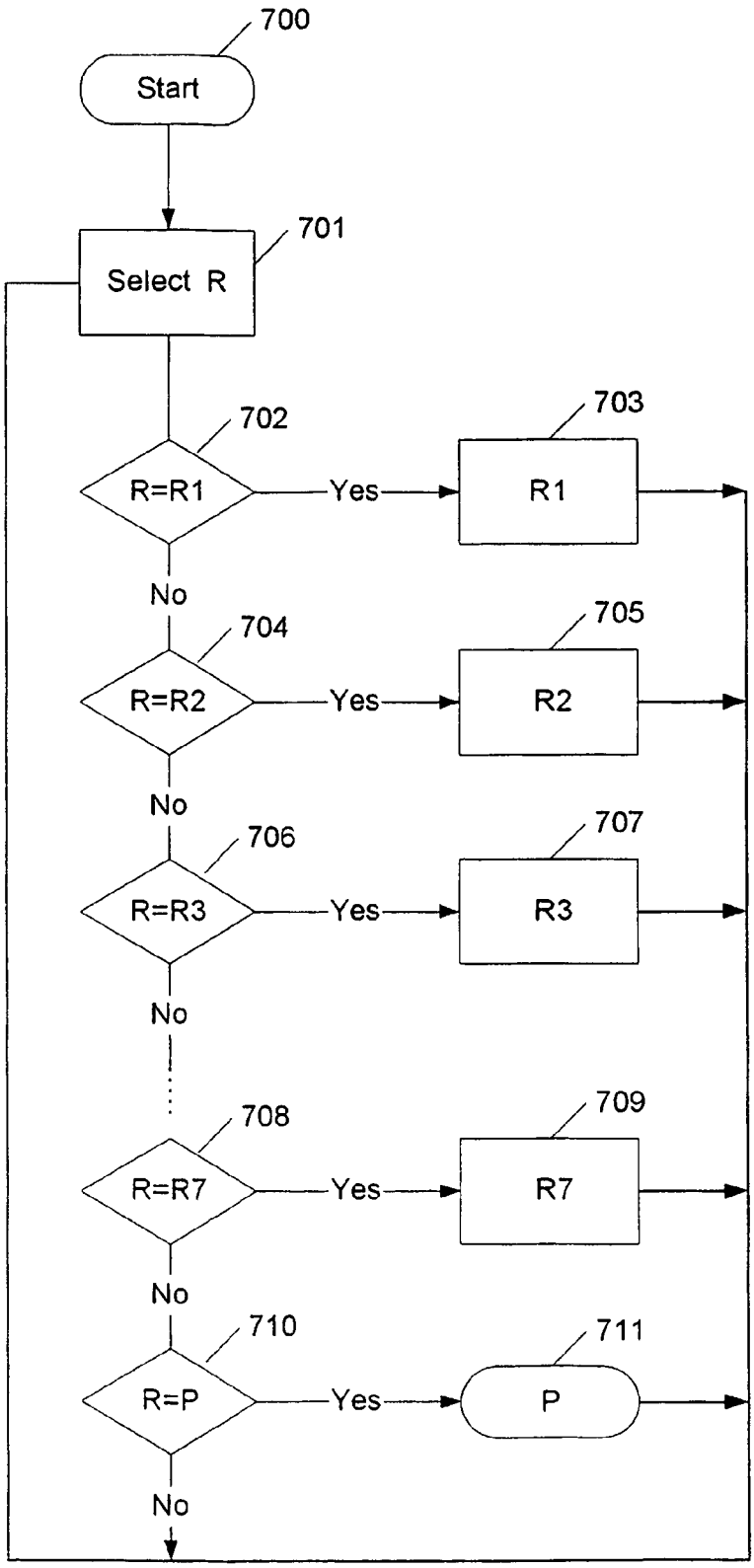
FIG. 7 shows a flow chart for a program for selecting a subset of program steps from a set of program steps in response to an operation selection.

FIG. 7 shows a program for selecting a subset of program steps from a set of program steps in response to an operation selection. The operation selection can e.g. take place by operating the switch 111. The flow chart starts in step 700. Then a subset of program steps is selected. A subset of program steps is also called a rule. In 701, rule R is selected from a collection of predetermined rules R1–R7 in the form of rule based programs stored in the memory 110. It is decided in step 702 whether the selected rule is R=R1. If this is the case (yes), the rule based program R1 is executed in step 703. Alternatively (no), it is checked whether rule R=R2 was selected. Correspondingly, it is decided in steps 704, 706 and 708 whether the selected rule is rule 2, 3 or 7, and respective rule based programs are executed in steps 705, 707 or 709. It is thus possible to select one of several predetermined rules. These rules may e.g. be determined by the manufacturer of the toy element.

As described above, it is possible to store user-defined rules by combining the predetermined rules.

Figure 8:
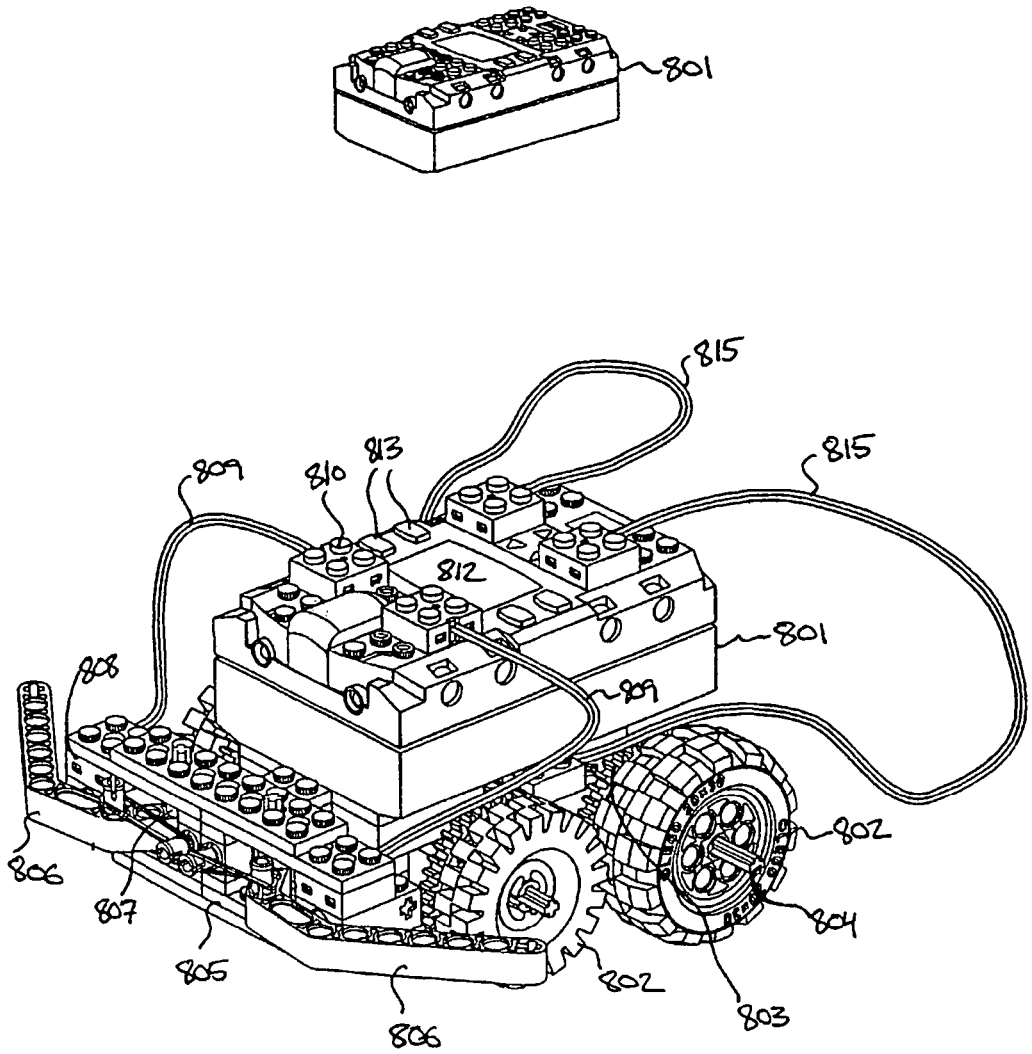
FIG. 8 shows a toy structure comprising a microprocessor controlled toy building element according to the invention coupled with generally known toy building elements.

FIG. 8 shows a toy structure comprising a microprocessor controlled toy building element according to the invention coupled together with generally known toy building elements. The microprocessor controlled toy building element 801 is coupled on top of a structure 805 of building elements and two motors (not shown). The motors drive a wheel at each side of the vehicle, of which only the wheel 802 on one side of the toy structure is visible. The wheels are driven by a shaft 804 which is connected with the motor via gear wheels 803. The motors are electrically connected to the toy building element 801 by means of wires 815.

The toy structure moreover comprises two movable arms 806 which are pivotable about a bearing 807, so that the arms, when being pivoted, can be caused to affect a set of switches 808. The switches 808 are electrically connected to the toy element 801 via wires 809.

The toy element may be operated via the keys 813. The display 812 can show information, as described above in connection with FIG. 2. The toy element 801 has a set of electrical contact faces 810 and 811, to which the wires 809 and 815 may be connected for receiving signals and emitting signals, respectively.

By suitable programming of the toy element 801 the vehicle may be caused to drive round obstacles that may affect the arms 806.

What is claimed is:

1. A microprocessor controlled toy building element (101, 501) comprising:

a microprocessor (102, 507) which can execute instructions in the form of a program stored in a memory (117, 509), said memory comprising subprograms (R1, R2, . . . , R6) which can be activated by subprogram calls;

coupling means mechanically inter-connectable with toy building elements (802–810) whereby a toy construction assembled from the microprocessor controlled toy building element (101, 501) and said toy building elements (801–810) can be moved around by activation means, said activation means being controllable in response to the instructions, a display which can show a plurality of icons which can be activated by a user, one-by-one, to create a program comprising a list of said subprogram calls, for programming of the microprocessor and controlling of the toy building element by means of the activation means;

communications means (504, 505) which is arranged to transmit the list of subprogram calls to a second toy building element (502) for programming of said second toy building element (502), whereby the toy building element (101, 501) and said second toy building element (502) can be moved in concert;

wherein the microprocessor, the display, the coupling means and the communications means are integral within the toy building element that provides a facility for transmitting a program and a programming facility that are integral portions within the toy building element wherein the program is run.

2. A microprocessor controlled toy building element according to claim 1, wherein instructions, corresponding to an icon, implement a rule (R1, R2, . . . , R6) by controlling the activation means in response to signals from sensors connected to the toy building element.

3. A microprocessor controlled toy building element according to claim 1, further comprising a receiver (504, 505) for wireless reception of instructions.

4. A microprocessor controlled toy building element according to claim 1, further comprising a receiver (505) for reception of infrared signals.

5. A microprocessor controlled toy building element according to claim 1, further comprising a keyboard for manual entering of instructions.

6. A microprocessor controlled toy building element according to claim 1, further comprising a transmitter (504, 505) for wireless transmission of instructions to the second toy.

7. A microprocessor controlled toy building element according to claim 1, further comprising a transmitter (504) for transmission of said function calls via a light guide (503).

8. A microprocessor controlled toy building element according to claim 1, further comprising an elongated light guide (503) through which visible light can be transmitted in its longitudinal direction, said light guide (503) being adapted to allow part of the light transmitted to escape through its sides.

9. A toy building set comprising microprocessor controlled toy building elements according to claim 1, further comprising first and second microprocessor controlled toy building elements (501, 502), where the second microprocessor controlled toy building element (502) comprises a memory (516) with subprograms (R1, R2, . . . , R6) which can be activated individually by receiving subprogram calls from the first toy building element (501).

10. A toy building set according to claim 9, wherein the first microprocessor controlled toy building element comprises operating means (508) for making a program, and that the second microprocessor controlled toy building element comprises operating means for activating just one of several programs.

11. A microprocessor controlled toy building element (101, 501) comprising a microprocessor (102, 507) which can execute instructions in the form of a program stored in a memory (117, 509), said memory comprising subprograms (R1, R2, . . . , R6) which can be activated by subprogram calls;

coupling means mechanically inter-connectable with toy building elements (802–810) whereby a toy construction assembled from the microprocessor controlled toy building element (101, 501) and said toy building elements (802–810) can be moved around by activation means, said activation means being controllable in response to the instructions;

a display which can show a plurality of icons which can be activated by a user, one-by-one, to create a program comprising a list of said subprogram calls, for programming of the microprocessor and controlling of the toy building element by means of the activation means;

wherein a subprogram sends a signal to the activation means and/or receives a signal from the activation means, and wherein the microprocessor controlled toy building element comprises communications means (504, 505) which is arranged to transmit the list of subprogram calls to a second toy building element (502) for programming of said second toy building element (502), whereby the toy building element (101, 501) and said second toy building element (502) can be moved in concert;

wherein the microprocessor, the display, the coupling means and the communications means are integral within the toy building element that provides a facility for transmitting a program and a programming facility that are integral portions within the toy building element wherein the program is run.

12. A microprocessor controlled toy building element according to claim 11, wherein instructions, corresponding to an icon, implement a rule (R1, R2, . . . , R6) by controlling the activation means in response to signals from sensors connected to the toy building element.

13. A microprocessor controlled toy building element according to claim 11, further comprising a receiver (504, 505) for wireless reception of instructions.

14. A microprocessor controlled toy building element according to claim 11, further comprising a receiver (505) for reception of infrared signals.

15. A microprocessor controlled toy building element according to claim 11, further comprising a keyboard for manual entering of instructions.

16. A microprocessor controlled toy building element according to claim 11, further comprising a transmitter (504, 505) for wireless transmission of instructions to the second toy.

17. A microprocessor controlled toy building element according to claim 11, further comprising a transmitter (504) for transmission of said function calls via a light guide (503).

18. A microprocessor controlled toy building element according to claim 11, further comprising an elongated light guide (503) through which visible light can be transmitted in its longitudinal direction, said light guide (503) being adapted to allow part of the light transmitted to escape through its sides.

19. A toy building set comprising microprocessor controlled toy building elements according to claim 11, further comprising first and second microprocessor controlled toy building elements (501, 502), where the second microprocessor controlled toy building element (502) comprises a memory (516) with subprograms (R1, R2, . . . , R6) which can be activated individually by receiving subprogram calls from the first toy building element (501).

20. A toy building set according to claim 19, wherein the first microprocessor controlled toy building element comprises operating means (508) for making a program, and that the second microprocessor controlled toy building element comprises operating means for activating just one of several programs.

21. A microprocessor controlled toy building element (101, 501) comprising a microprocessor (102, 507) which can execute instructions in the form of a program stored in a memory (117, 509), said memory comprising subprograms (R1, R2, R6) which can be activated by subprogram calls;

coupling means mechanically inter-connectable with toy building elements (802–810) whereby a toy construction assembled from the microprocessor controlled toy building element (101, 501) and said toy building elements (802–810) can be moved around by activation means, said activation means being controllable in response to the instructions;

a display which can show a plurality of icons which can be activated by a user, one-by-one, to create a program comprising a list of said subprogram calls, for programming of the microprocessor and controlling of the toy building element by means of the activation means;

wherein the microprocessor controlled toy building element comprises communications means (504, 505) which is arranged to transmit the list of subprogram calls to a second toy building element (502), whereby the toy building element (101, 501) and said second toy building element (502) can be moved in concert;

wherein the microprocessor, the display, the coupling means and the communications means are integral within the toy building element that provides a facility for transmitting a program and a programming facility that are integral portions within the toy building element wherein the program is run; and wherein the second toy building element comprises a second memory, which second memory also comprises the subprograms (R1, R2, . . . , R6).

22. A microprocessor controlled toy building element according to claim 21, wherein instructions, corresponding to an icon, implement a rule (R1, R2, . . . , R6) by controlling the activation means in response to signals from sensors connected to the toy building element.

23. A microprocessor controlled toy building element according to claim 21, further comprising a receiver (504, 505) for wireless reception of instructions.

24. A microprocessor controlled toy building element according to claim 21, further comprising a receiver (505) for reception of infrared signals.

25. A microprocessor controlled toy building element according to claim 21, further comprising a keyboard for manual entering of instructions.

26. A microprocessor controlled toy building element according to claim 21, further comprising a transmitter (504, 505) for wireless transmission of instructions to the second toy.

27. A microprocessor controlled toy building element according to claim 21, further comprising a transmitter (504) for transmission of said function calls via a light guide (503).

28. A microprocessor controlled toy building element according to claim 21, further comprising an elongated light guide (503) through which visible light can be transmitted in its longitudinal direction, said light guide (503) being adapted to allow part of the light transmitted to escape through its sides.

29. A toy building set comprising microprocessor controlled toy building elements according claim 21, further comprising first and second microprocessor controlled toy building elements (501, 502), where the second microprocessor controlled toy building element (502) comprises a memory (516) with subprograms (R1, R2, . . . , R6) which can be activated individually by receiving subprogram calls from the first toy building element (501).

30. A toy building set according to claim 29, wherein the first microprocessor controlled toy building element comprises operating means (508) for making a program, and that the second microprocessor controlled toy building element comprises operating means for activating just one of several programs.

31. A microprocessor controlled toy building element (101, 501) comprising:

a microprocessor (102, 507) which can execute instructions in the form of a program stored in a memory (117, 509), said memory comprising subprograms (R1, R2, . . . , R6) which can be activated by subprogram calls;

coupling means mechanically inter-connectable with toy building elements (802–810) whereby a toy construction assembled from the microprocessor controlled toy building element (101, 501) and said toy building elements (801–810) can be moved around by activation means, said activation means being controllable in response to the instructions;

a display which can show a plurality of icons which can be activated by a user, one-by-one, to create a program comprising a list of said subprogram calls, for programming of the microprocessor and controlling of the toy building element by means of the activation means;

communications means (504, 505) which is arranged to transmit the list of subprogram calls to a second toy building element (502) for programming of said second toy building element (502);

wherein the microprocessor, the display, the coupling means and the communications means are integral within the toy building element that provides a facility for transmitting a program and a programming facility that are integral portions within the toy building element wherein the program is run.

32. A microprocessor controlled toy building element (101, 501) comprising a microprocessor (102, 507) which can execute instructions in the form of a program stored in a memory (117, 509), said memory comprising subprograms (R1, R2, . . . , R6) which can be activated by subprogram calls;

coupling means mechanically inter-connectable with toy building elements (802–810) whereby a toy construction assembled from the microprocessor controlled toy building element (101, 501) and said toy building elements (802–810) can be moved around by activation means, said activation means being controllable in response to the instructions;

a display which can show a plurality of icons which can be activated by a user, one-by-one, to create a program comprising a list of said subprogram calls, for programming of the microprocessor and controlling of the toy building element by means of the activation means;

wherein a subprogram sends a signal to the activation means and/or receives a signal from the activation means; and wherein the microprocessor controlled toy building element comprises communications means (504, 505) which is arranged to transmit the list of subprogram calls to a second toy building element (502) for programming of said second toy building element (502);

wherein the microprocessor, the display, the coupling means and the communications means are integral within the toy building element that provides a facility for transmitting a program and a programming facility that are integral portions within the toy building element wherein the program is run.

33. A microprocessor controlled toy building element (101, 501) comprising a microprocessor (102, 507) which can execute instructions in the form of a program stored in a memory (117, 509), said memory comprising subprograms (R1, R2, R6) which can be activated by subprogram calls;

coupling means mechanically inter-connectable with toy building elements (802–810) whereby a toy construction assembled from the microprocessor controlled toy building element (101, 501) and said toy building elements (802–810) can be moved around by activation means, said activation means being controllable in response to the instructions;

a display which can show a plurality of icons which can be activated by a user, one-by-one, to create a program comprising a list of said subprogram calls, for programming of the microprocessor and controlling of the toy building element by means of the activation means;

wherein the microprocessor controlled toy building element comprises communications means (504, 505) which is arranged to transmit the list of subprogram calls to a second toy building element (502);

wherein the microprocessor, the display, the coupling means and the communications means are integral within the toy building element that provides a facility for transmitting a program and a programming facility that are integral portions within the toy building element wherein the program is run; and wherein the second toy building element comprises a second memory, which second memory also comprises the subprograms (R1, R2, . . . , R6).

* * * * *